US006898292B2

(12) United States Patent
Tanabe et al.

(10) Patent No.: US 6,898,292 B2
(45) Date of Patent: May 24, 2005

(54) ELECTRET MICROPHONE

(75) Inventors: Haruhisa Tanabe, Yamanashi-ken (JP); Koji Takayama, Tokyo (JP)

(73) Assignee: Citizen Electronics Co., Ltd., Fujiyoshida (JP)

( * ) Notice: Subject to any disclaimer, the term of this patent is extended or adjusted under 35 U.S.C. 154(b) by 330 days.

(21) Appl. No.: 10/141,822

(22) Filed: May 10, 2002

(65) Prior Publication Data

US 2002/0172385 A1 Nov. 21, 2002

(30) Foreign Application Priority Data

May 16, 2001 (JP) ..... 2001-147099

(51) Int. Cl.[7] ..... H04R 25/00

(52) U.S. Cl. ..... 381/191; 381/396; 381/398; 381/174

(58) Field of Search ..... 381/191, 396, 381/398, 174; 367/178, 180

(56) References Cited

U.S. PATENT DOCUMENTS 5,272,758 A * 12/1993 Isogami et al. ..... 381/191

FOREIGN PATENT DOCUMENTS

JP 2000197192 7/2000

* cited by examiner

*Primary Examiner*—Rexford Barnie
*Assistant Examiner*—Tuan Duc Nguyen
(74) *Attorney, Agent, or Firm*—Dennison, Schultz, Dougherty & MacDonald

(57) ABSTRACT

An electret microphone comprises a back plate having a stationary back electrode and secured to a substrate. An electret layer is formed on the stationary back electrode and a spacer is mounted on the back plate. A diaphragm electrode is mounted on the spacer.

5 Claims, 4 Drawing Sheets

ELECTRET MICROPHONE

BACKGROUND OF THE INVENTION

The present invention relates to a condenser microphone, and more particularly to an electret microphone used for a portable telephone, video camera and others.

A conventional electret microphone comprises a microphone part and a case part storing the microphone part. The microphone part is composed of metal except for a substrate made of plastic, and the case part is mainly composed of metal. However, such a metal constitution has disadvantages in processing and assembly accuracy. Consequently, it is difficult to manufacture an electret microphone having a small size and high performance.

Japanese Patent Application Laid Open 2000-50393 discloses an electret microphone mainly composed of ceramic.

FIG. 4 is a sectional view showing the electret microphone. The electret microphone comprises a microphone part 100 and a case part 200.

The case part 200 comprises a substrate 210 made of insulation material, a first frame 220, second frame 230, third frame 240, fourth frame 250, and a cover 260, which frames and cover are stacked on the substrate 210 and adhered to each other. The first, second and third frames 220, 230 and 240 are made of ceramic, and the fourth frame 250 is made of metal.

As shown in FIG. 5, each of the frames 220, 230, 240 and 250 has a square shape. On the substrate 210 and first to third frames 220–240, connecting electrodes 210*b*, 220*b*, 230*b* and 240*b* are provided by conductive films, and these electrodes are contacted with each other. Outside sizes of the frames are same, but inside size of the third frame 240 is larger than that of the first and second frames 220 and 230, and the inside size of the fourth frame 250 is larger than that of the third frame 240. Thus, a first shoulder 230*a* and a second shoulder 240*a* are formed on the second frame 230 and on the third frame 240.

Referring to FIG. 4, the microphone part 100 comprises a back electrode 110 made of metal and secured to the first shoulder 230*a*, an electret layer 120 formed on the back electrode 110, a diaphragm electrode 140 mounted on the third frame 240 interposing a lower spacer 150, and an upper spacer 160 between the diaphragm electrode 140 and the cover 260.

The diaphragm electrode 140 and the back electrode 110 compose a condenser. The diaphragm electrode 140 is vibrated by air entering passing through a sound collecting hole 260*a* of the cover 260. The capacitance of the condenser changes with the vibration of the diaphragm electrode 140 to generate an electric signal. The electric signal is transmitted to an integrated circuit 170 on the substrate 210 through connecting electrodes 210*b*, 220*b* and 240*b*.

The electret microphone can be manufactured with high accuracy, because the frames are made of ceramic.

However, the back electrode 110, diaphragm electrode 140 and the fourth frame 250 are made of metal. Therefore, there are problems about temperature characteristic and others based on differences in manufacturing accuracy and coefficient of thermal expansion.

Furthermore, it is difficult to miniaturize the microphone, because of double construction that the back electrode 110 and the diaphragm electrode 140 are assembled in the case part 200 comprising the first frame 220, second frame 230, third frame 240, and fourth frame 250.

SUMMARY OF THE INVENTION

An object of the present invention is to provide an electret microphone which may be manufactured in small size with high accuracy.

According to the present invention, there is provided an electret microphone comprising a substrate having a circuit, a back plate having a stationary back electrode and secured to the substrate, an electret layer formed on the stationary back electrode, a spacer mounted on the back plate, a diaphragm electrode on the spacer, and a frame mounted on the diaphragm electrode.

The substrate, the back plate and the frame are made of same material.

Connecting electrodes are provided on the substrate and the back plate for connecting the back electrode and the diaphragm electrode to the circuit on the substrate respectively.

A shield made of metal is provided for shielding the microphone, and for connecting the back electrode to the circuit.

These and other objects and features of the present invention will become more apparent from the following detailed description with reference to the accompanying drawings.

DETAILED DESCRIPTION OF THE PREFERRED EMBODIMENT

Figure 1:
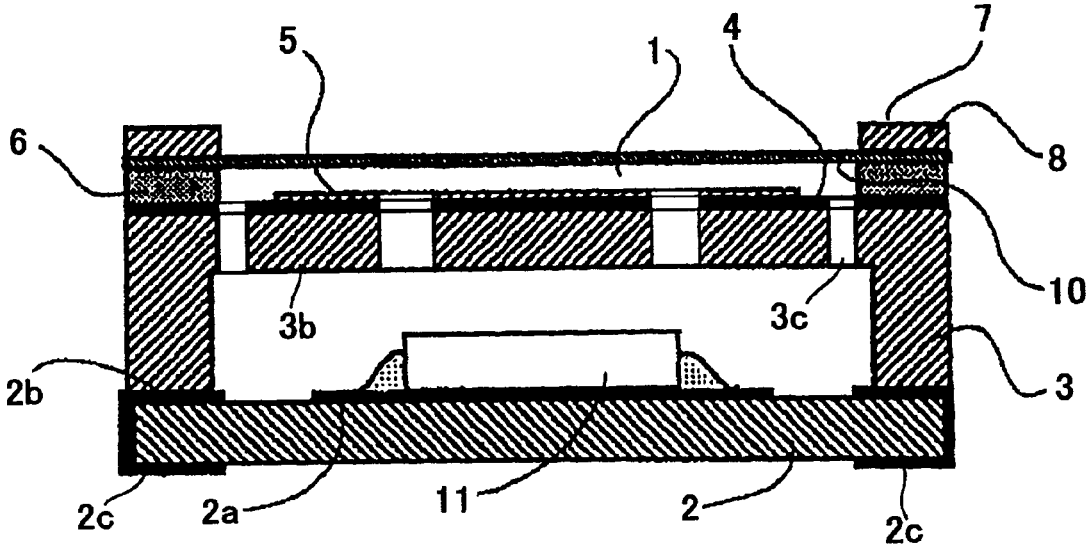
FIG. 1 is a sectional view showing an electret microphone according to the present invention.

The electret microphone of the present invention comprises a substrate 2 having printed circuit 2*a*, connecting electrodes 2*b*, and output electrodes 2*c*, an integrated circuit (IC) 11 securely mounted on the substrate 2, a back plate 3 having connecting electrodes 3*a*, a recess 3*b* for the IC 11 and vents 3*c*, and secured to the substrate 2, a stationary back electrode film 4 formed on the surface of the back plate 3, and a frame 8 mounted on the back plate 3 interposing a spacer 6 having an opening 6*a*. The substrate 2, back plate 3, frame 8 are made of ceramic or plastic. A diaphragm electrode film 10 as a movable electrode is formed on a mounting electrodes 9 formed on the underside of the frame 8. An electret film 5 is formed on the back electrode 4. Each of the elements 2, 3, 6 and 8 are adhered with adhesive.

The diaphragm electrode film 10 is electrically connected to one of the connecting electrodes 3*a* through the electrodes 9 and a lead (not shown) passing in the spacer 6, and connected to the printed circuit 2*a* through one of the connecting electrodes 2*b*. The back electrode film 4 is connected to the circuit 2*a* by the other electrodes 3*a* and 2*b*. Thus, the stationary back electrode film 4 and the diaphragm electrode film 10 compose a condenser.

When the diaphragm electrode film 10 is vibrated by air entering the frame 8, the capacitance of the condenser changes with the vibration of the diaphragm electrode film 10 to generate an electric signal. The electric signal is transmitted to the integrated circuit 11 on the substrate 2 through connecting electrodes 3*a* and 2*b*.

Figure 2:
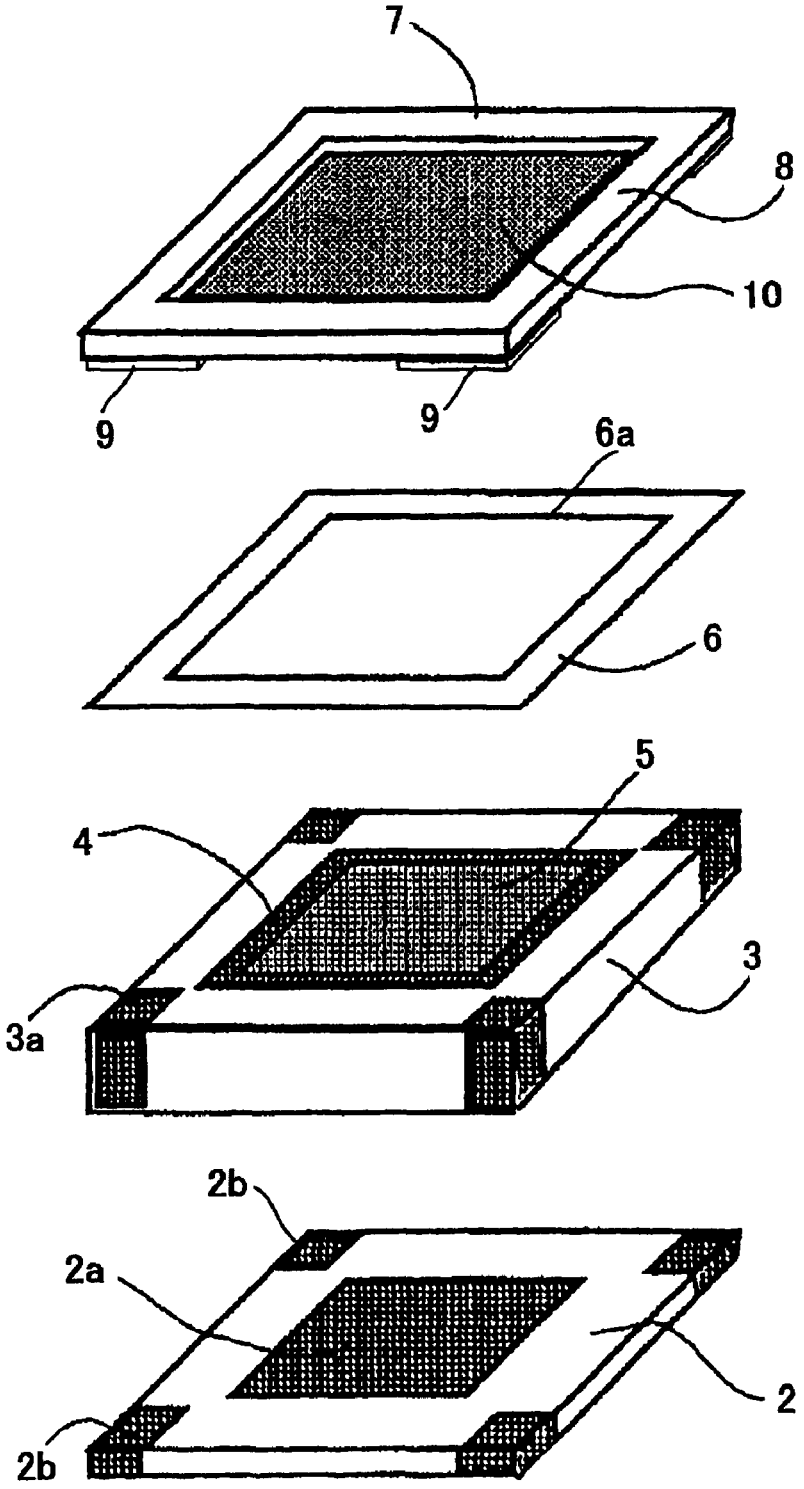
FIG. 2 is an exploded perspective view of the electret microphone.
Figure 3:
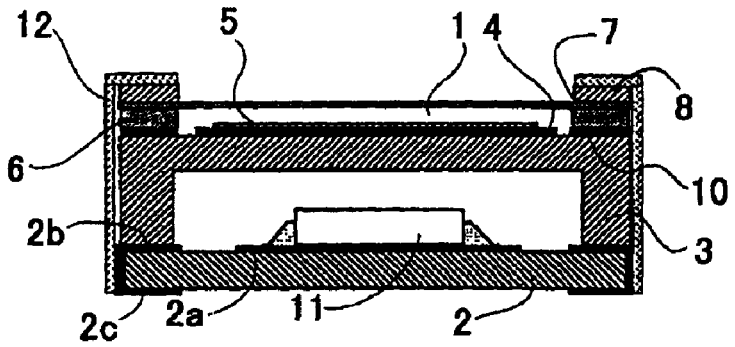
FIG. 3 is a sectional view of anther embodiment of the present invention.
Figure 4:
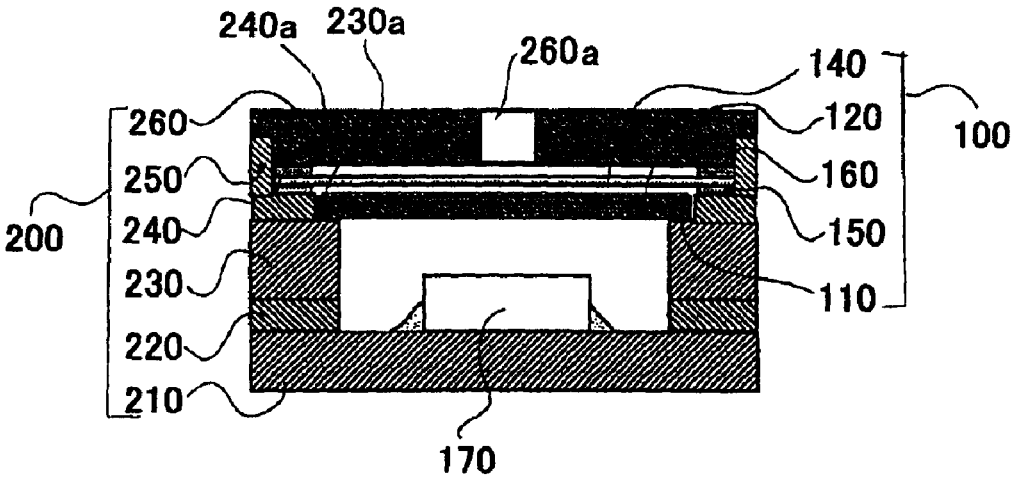
FIG. 4 PRIOR ART
FIG. 4 is a sectional view showing a conventional electret microphone.
Figure 5:
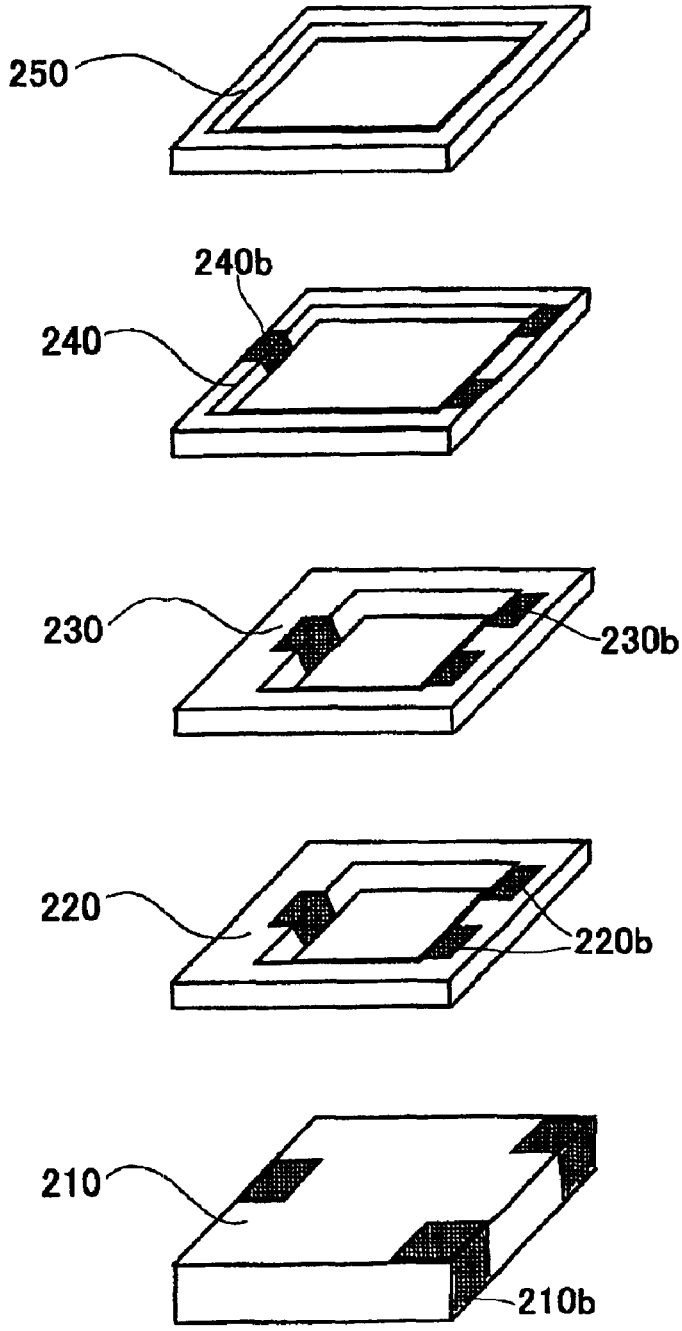
FIG. 5 PRIOR ART
FIG. 5 is an exploded perspective view of the electret microphone.

Referring to FIG. 3 showing another embodiment of the present invention, a shield 12 made of metal plates is adhered on outside walls of the electret microphone in order to shield the microphone. Other elements are the same as the first embodiment and identified with the same reference numerals as FIGS. 1 and 2.

In the electret microphone, the back electrode film 4 is connected to the shield 12, and the shield 12 is connected to the circuit 2*a*. The diaphragm electrode film 10 is connected to the circuit 2*a* by a wire passing through holes provided in intermediate members.

In accordance with the present invention, composition elements of the electret microphone are assembled without casing. Thus, the microphone can be easily manufactured into a small size with high accuracy. Furthermore, the problems due to the differences of coefficient of thermal expansion is dissolved by composing the composition elements with the same material, thereby improving acoustic characteristic.

While the invention has been described in conjunction with preferred specific embodiment thereof, it will be understood that this description is intended to illustrate and not limit the scope of the invention, which is defined by the following claims.

What is claimed is:

1. An electret microphone comprising:

a substrate having a circuit disposed thereon;

a back plate having a stationary back electrode formed on a surface of the back plate and side walls secured to the substrate, said side walls defining a recess on an underside of the surface for receiving the circuit on the substrate;

an electret layer formed on the stationary back electrode;

a spacer mounted on the back plate;

a diaphragm electrode on the spacer; and a frame mounted on the diaphragm electrode, wherein the substrate, back plate, spacer and frame are co-extensive in outline share and size, and the side walls of the substrate, the back plate and the annular spacer form an outside wall of a case for the microphone.

2. The electret microphone according to claim 1 wherein the substrate, the back plate and the frame are made of same material.

3. The electret microphone according to claim 1 further comprising connecting electrodes provided on the substrate and the back plate for connecting the back electrode and the diaphragm electrode to the circuit on the substrate respectively.

4. The electret microphone according to claim 1 further comprising a shield made of metal for shielding the microphone.

5. The electret microphone according to claim 4 wherein the shield is provided for connecting the diaphragm electrode to the circuit.

* * * * *